United States Patent [19]

Apblett, Jr. et al.

[11] 4,419,144

[45] Dec. 6, 1983

[54] SPALL-RESISTANT STEEL TUBING OR OTHER STEEL ARTICLES SUBJECTED TO HIGH TEMPERATURE STEAM AND METHOD

[75] Inventors: William R. Apblett, Jr., Florham Park; Irwin M. Rehn, Boonton, both of N.J.

[73] Assignee: Electric Power Research Institute, Inc., Palo Alto, Calif.

[21] Appl. No.: 159,682

[22] Filed: Jun. 16, 1980

[51] Int. Cl.[3] ..... C23F 7/26

[52] U.S. Cl. ..... 148/6.2; 148/6.35

[58] Field of Search ..... 148/6.2, 6.35

[56] References Cited

U.S. PATENT DOCUMENTS 2,858,244 10/1958 Long et al. ..... 148/6.35

3,969,153 7/1976 Suzuki et al. ..... 148/6.35

*Primary Examiner*—Sam Silverberg

*Attorney, Agent, or Firm*—Flehr, Hohbach, Test, Albritton & Herbert

[57] ABSTRACT

A process is disclosed herein in which the inner surface of a ferritic steel tube is subjected to relatively high temperature steam for a period of time, thereby resulting in the formation of a duplex scale layer of steam-grown oxide at the inner surface. As also disclosed herein, the steel tubing is pretreated so as to form a diffusion barrier at the center of the duplex layer. This barrier serves to retard the rate at which the duplex layer forms, thereby reducing the chances that the scale will grow to sufficient thickness that it will spall in response to thermal stress as the tube is placed into and taken out of service.

13 Claims, 5 Drawing Figures

SPALL-RESISTANT STEEL TUBING OR OTHER STEEL ARTICLES SUBJECTED TO HIGH TEMPERATURE STEAM AND METHOD

The present invention relates generally to steel surfaces which are exposed to relatively high temperature in an air but especially a steam environment for prolonged periods of time, thereby resulting in the formation of a duplex scale layer of steam-grown oxide, and more particularly to a steel tube or similar article which has been pretreated to retard the rate at which the duplex scale layer forms.

For many years, little attention has been paid to corrosion effects on the steam side of austenitic and ferritic steels which are used for super-heater and reheater tubes in modern power generation boilers. This is because even at temperatures approaching 650° C. (1200° F.) steam is a relatively innocuous environment, compared with the severe operating conditions on the fire side of the tubes. Long term exposure trials having tended to confirm that the commonly used 300 series austenitic steels form protective oxides with acceptable and predictable metal loss rates. The same is frequently true for ferritic steels, although for those containing about 9% chromium or less, thicker scales than predicted sometimes form at para-linear rates.

The normal or typical protective scale formed on the inner surface of a ferritic tube which has been subjected to relatively high temperature steam (for example, steam approaching 650° C.) is a steam-grown oxide in the form of a duplex scale layer which will be discussed in more detail hereinafter. For the moment is should suffice to point out that this duplex scale layer includes an outer layer of primarily magnetite ($Fe_3O_4$) which is located outwardly of the original inner diameter of the tube and an equally thick inner layer located inwardly of the original inner diameter. Where the tube is ferritic steel without significant amounts of alloy elements, the inner layer is also primarily magnetite, but with the original alloying elements present. However, when the steel is alloyed with chromium, the inner layer typically includes particles of Fe-Cr spinel ($FeCr_2O_4$).

While the protective oxide formed on austenitic steel tubes and the duplex layer formed on ferritic steel tubes do not normally adversely affect the intended operation of the tubes, there have been problems relating to spalling or exfoliation of the oxide scale in both types of tubing, particularly after operating periods of 5000 hours or more. More specifically, it has been found that after the scale has formed to a certain thickness, whether the scale is a single protective oxide layer as on austenitic steel tubing or a duplex layer as on ferritic steel tubing, there is a tendency for the scale to spall or exfoliate, that is, break away from the tubing itself. Although isothermal exfoliation has been reported in the past, the most prevalent type is associated with large temperature changes, such as occur with shut-down cycles.

A number of experts in the field have concluded that the shear stress resulting from the difference in thermal expansion of the scale compared with that of the non-scale metal is the primary cause of spalling. While this may or may not be the only reason and while there might be other significant causes, the end result is the same. In the case of austenitic steel tubing, there has been a tendency for the spalled scale to lodge within the tubing causing blockage, steam starvation and occasional overheating and bursting of the superheater and reheater tubes. On the other hand, with respect to ferritic steel tubing, the primary problem has resulted from spalled scale or oxide flakes becoming entrained in the steam flow and passing to the turbine where they can cause severe erosion damage.

Heretofore, there have been numerous suggested ways to overcome these spalling problems associated with the formation of an oxide scale on the inner surface of the tubes whether it be of the single layer type or a duplex. For example, one suggestion has been to make sure that the tubing itself is physically constrained so as to prevent mechanical movement which may be a primary cause of spalling. While this is a valid suggestion and in most cases a necessary condition to prevent spalling or exfoliation of even relatively thin scale layers, it does not entirely solve the problem, even if suitable constraints could be provided for completely eliminating mechanical movement. However, in the absence of mechanical strain, scale exfoliation is only likely to occur during shut-down periods as the tubing cools. This cooling down process causes major strains as a result of (1) removal of heat flux and (2) the creation of a thermal mismatch between the metal and scale layer as well as between the tubing itself and its associated supports. While from a practical standpoint it is virtually impossible to eliminate all of these strains, it is possible to reduce the tube-support mismatch strains by changing the support material and making it more compatible from a thermal expansion-contraction standpoint with the tubing. However, this does not eliminate oxide spalling under many operating conditions and there have, consequently, been a number of other suggestions in the past. As will be discussed below, these additional suggestions have included removing the oxide chemically before it spalls, affecting the time at which spalling occurs, replacing the tubing with a more spall-resistant material and carrying out a surface treatment on the tubing.

Removing the oxide chemically before it spalls involves cleaning the tubes at calculated intervals, ideally at intervals shorter than the time at which spalling is likely to begin. If the chemical cleaning frequency is greater than the spalling frequency there should not be a spalling problem at all. In this regard, the prior art has suggested many different chemical agents as hydroxyacetic-formic acid mixtures containing ammonium bifluoride as well as EDTA base chelating agents. While this approach may have it attractions, there are a number of attendant problems including those which generally occur when considering the chemical cleaning of furnace wall tubing. These include the need to establish a criterion for ordering a cleaning, how to prove the effectiveness of the cleaning, the avoidance of unnecessary loss of metal wall section and the need to establish that the cleaning agents produce no damage to the boiler. Moreover, there are economic and time considerations since the cost of carrying out a periodic cleaning procedure and the time it takes can be relatively large.

Another suggestion referred to above, is that of controlling the time at which the oxide scale layer is released and particularly to an operational procedure which initiates spalling when the particles are too small or too few to cause blockage in the boiler or damage to the turbine. However, to date this procedure has not developed sufficiently to be considered from a practical standpoint. Another related suggestion has been to actively prevent damage or tube blockage of the released oxide, as also stated above. In this regard, it has been found that spalling generally occurs during shut-down. Accordingly, one approach has been to provide inspection techniques during these periods. For austenitic tubes there is a very simple monitoring technique available because the tubes are non-magnetic and the spalled scale or debris is magnetic (magnetite). As a result, a small hand-held permanent magnet can be placed on the underside of a tube end and the volume of magnetite debris estimated subjectively by the strength of magnetic attraction. Those tubes having a large amount of debris collected at their bends are cut out, the debris is emptied and the tube is rewelded in place.

Although the procedure just described is quick and simple and has been practiced in the past, it does have several shortcomings. Most importantly, it does not provide the ability to differentiate between aggregates of spalled debris and thick adherent duplex scale. Another procedure and one which would eliminate this problem relies on the use of conventional in situ radiography. However, this would be expensive and time consuming as a primary technique. In any event, the simple magnetic approach is not available for ferritic tubes. However, attempts have been made to develop a detector in which the ferritic steel is magnetically saturated so that the magnetite debris in the tube can be estimated. However, at the present time there are difficulties with the design of a suitable instrument to apply this technique.

Other suggested ways to eliminate the problem of debris have included specific procedures for start-up after a shut-down to eliminate blockage, but, of course, this only benefits those systems where blockage is the only problem. There have also been suggestions relating to design modifications of the tubing system, the most obvious of which has been to avoid narrow bore tubing. However, this again at most solves the blockage problem.

As indicated above, there is always the possibility of replacing the tubing with a more spall-resistant material. However, this is not a viable option for existing facilities because of its expense, except, of course, when replacing the superheater and reheater tubes for other reasons. It is, of course, a viable solution in designing new boilers. One suggestion recited above was to carry out a surface treatment on the tubing itself. In this respect, previously suggested cold-work treatments applied to the surface of 300 series austenitic steel have been found to impart dramatically improved corrosion resistance by encouraging the formation of thin chromium (Cr) rich sesquioxides instead of thick two-layered magnetite scales normally formed on the tubing. A practical limitation which has prevented the immediate specification of cold work treatments for austenitic tubing is the need for post-fabrication heat treatments [typically 1025° C. (1880° F.) for 15 minutes] for cold-bent tube platens. Such a heat treatment is likely to destroy the effects of cold work but the oxide formed during the heat treatment may still be a stable sesquioxide. Another procedure, specifically a chromizing procedure has been successful in eliminating scale spalling or at least reducing it to a satisfactory level. However, this latter procedure also has its attendant drawbacks. One main drawback resides in the requirement tht the Cr be diffused at temperatures on the order of 1850° F. Hence, it is not practical to carry out this procedure on existing tubing at the site itself.

As will be seen hereinafter, the present invention is also directed to eliminating the problem of scale spalling and, as will also be seen, this is accomplished by preventing scale spalling during the useful life of the tubing rather than by the other suggested methods. However, the particular approach of the present invention is one which may be carried out economically, in an uncomplicated way and directly at the site on existing tubing.

One object of the present invention is to provide a method of reducing the possibility of scale spalling on the inner surface of the previously described tubing or similar metal surfaces used for other purposes and particularly ferritic steel tubing which is subjected to thermal stress.

Another object of the present invention is to provide a particular pretreatment process for ferritic steel tubing so that when the latter is subjected to relatively high temperature steam, as described previously, or even when subjected to a relatively high temperature air environment (in the absence of steam) the rate at which its duplex scale layer of steam-grown oxide is formed is retarded or slowed down appreciably.

Still another object of the present invention is to provide a pretreatment process which results in the formation of a centrally located spinel barrier during formation of and within the duplex scale.

A further object of the present invention is to provide a pretreated ferritic steel tube which resists spalling.

Still a further object of the present invention is to provide a pretreated, ferritic steel tube which not only forms a duplex scale layer of steam-grown oxide when subjected to relatively high temperature environment, especially an environment of steam, but also forms a spinel at the center of the duplex scale for retarding the rate at which the duplex scale forms.

Still another object of the present invention is to provide a pretreatment process which is equally applicable to and provides the same advantages for ferritic steel members other than tubing.

As indicated above, the present invention relates to a process in which a surface of a ferritic steel member is subjected to a relatively high temperature environment, especially steam, for a period of time resulting in the formation of a duplex scale layer at its surface. The present invention is related specifically to a method of reducing the possibility of scale spalling at the surface. As will be seen hereinafter, this is accomplished by pretreating the surface with particular substances in a particular way to cause the formation of a spinel barrier of one of the substances, specifically chromium in a preferred embodiment, at the center of the duplex layer. This spinel barrier has been found to retard the rate at which the duplex scale layer forms at the surface, thereby reducing the possibility of scale spalling. In a preferred embodiment, the pretreatment procedure is one which results in the formation of a $(Fe,Cr)_2O_4$ spinel barrier which impedes the outward diffusion of $Fe^{++}$ ions and the inward diffusion of $O^{=}$ ions.

Figure 1:
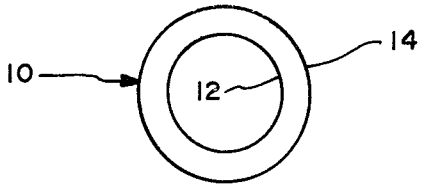
FIG. 1 is a cross-sectional view of a ferritic steel tube prior to the formation of a duplex scale layer of steam-grown oxide at its inner surface.

Turning now to the drawings, FIG. 1 specifically illustrates the cross-section of a ferritic steel tube 10 prior to being subjected to steam. As seen in this figure, the tube includes a relatively smooth, clean inner surface 12, that is, a surface which is free of any significant oxide scale and an outer surface 14 which is also shown smooth. In this regard, ferrous iron (Fe) in the tubing will to a limited degree oxidize at the inner surface as well as at the outer surface of the tubing since it is exposed to the oxygen in the air. However, for purposes of the present invention, these relatively thin layers of oxide can be ignored. In an actual embodiment, tube 10 is comprised of a relatively low alloy steel tube including chromium (Cr) and molybdenum (Mo), specifically a 2.5% Cr-1% Mo steel tube. There are also other elements making up the tube, particularly silicon (Si) and manganese (Mn), as will be seen hereinafter.

Whether or not the tube 10 illustrated in FIG. 1 is pretreated in accordance with the present invention, if its inner surface 12 is subjected to relatively high temperature steam-grown oxide will form at the surface. Apart from the present invention, the exact nature of this duplex layer (for untreated tubes) as well as the way in which it is formed is well known in the art and hence will not be discussed in depth, except as it relates to the present invention. It should suffice to say that the duplex layer forms outward from previously recited surface 12, that is, away from this surface and the rest of the steel body to provide what may be referred to as an outer sublayer and it forms inward at approximately the same rate into the steel body so as to provide what may be referred to as an inner sublayer of equal thickness.

Figure 2:
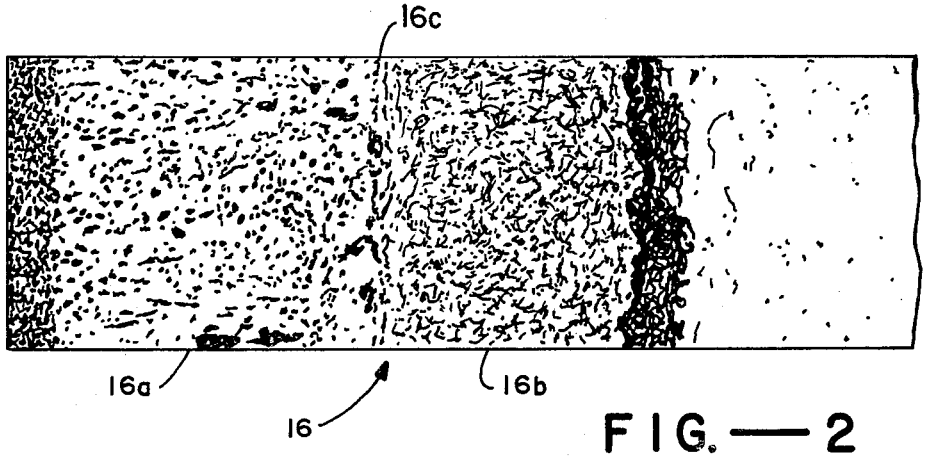
FIG. 2 is a cross-sectional view obtained by a scanning electron microscope (SEM) of the inner surface of a ferritic steel tube which has not been pretreated in accordance with the present invention, but which has been subjected to relatively high temperature steam sufficient to form a duplex scale layer of steam-grown oxide at its inner surface.
Figure 3:
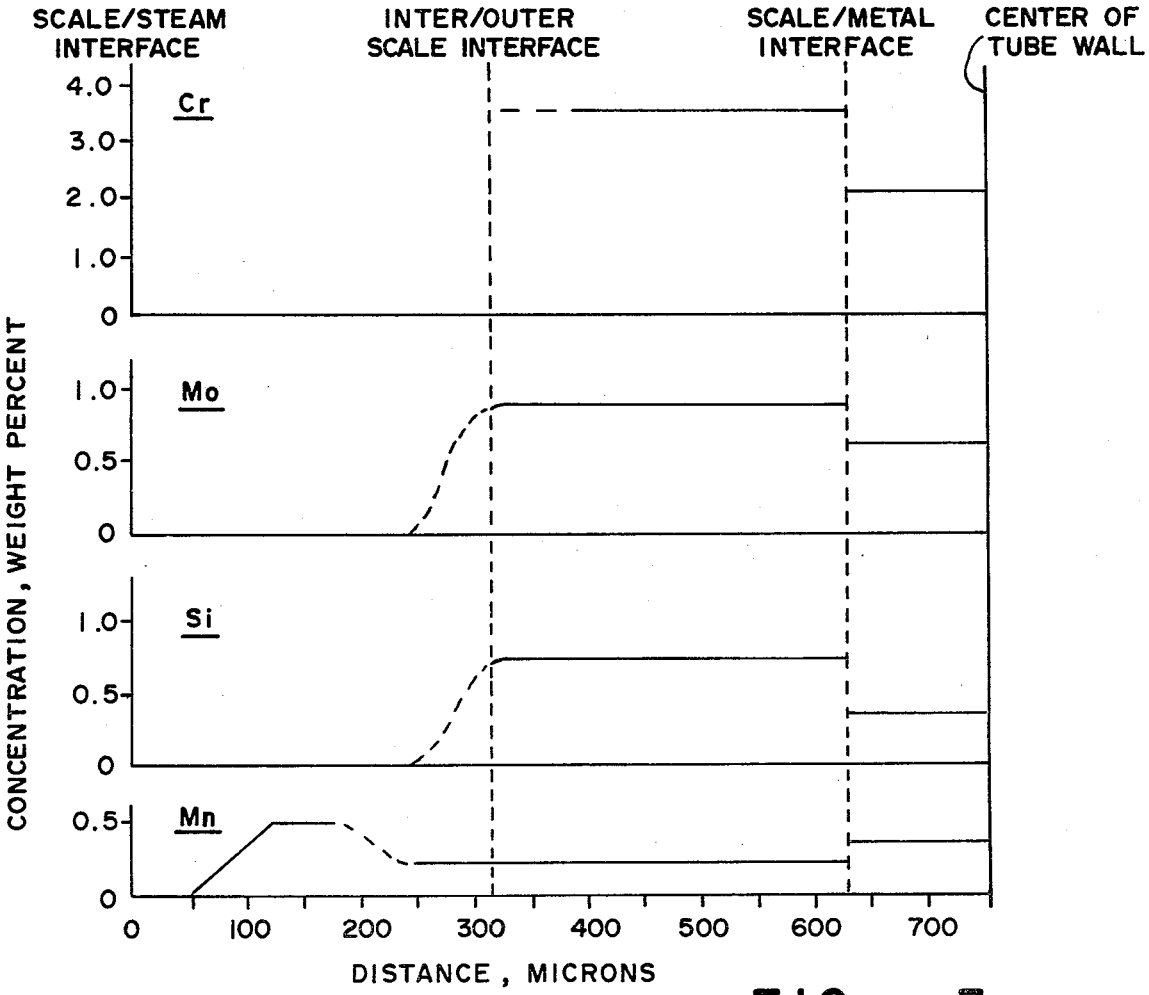
FIG. 3 is an Electron Microprobe Line Scan analysis (normal to the surface) of certain components making up the duplex layer of FIG. 2.

Both sublayers consist primarily of magnetite ($Fe_3O_4$), although the inner layer is generally more dense than the outer layer. As a result of this difference in densities, there is a distinct boundary between the two which corresponds to the position of the original metal surface, that is inner surface 12 of FIG. 1. Moreover, where the steel tubing includes Cr-Mo alloy constituents, the sublayers will also include, in addition to these constituents, silicon and manganese, although Cr is generally not found in the outer sublayer and at most small ammounts of Mo and Si are found in the inner sublayer, usually near the boundary. However, a measurable increase in the amount of Mn is found in the outer sublayer whereas a smaller amount is usually found in the inner sublayer. This is best illustrated in FIGS. 2 and 3 which will be discussed hereinafter. In any event, it has been found that if this duplex is allowed to become too thick, for example in excess of 24 mils, it will have the tendency to exfoliate or spall as a result of thermally induced stress, primarily caused by shut-down, that is, a reduction in temperature from an operating level of 1000° F. to its shut-down (ambient) temperature. As stated previously and as will be seen hereinafter, the primary objective of the present invention is not to eliminate the formation of a duplex scale but rather to impede its rate of growth so that it never reaches the critical spalling thickness during its normal useful life, for example 200,000 hours of operation. This has been accomplished in accordance with the present invention by the formation of a spinel at the center of the duplex scale, that is, at the boundary of the two sublayers, as will be described in more detail hereinafter.

Before going further, it is to be understood that spinels generally are well known in the art. Moreover, the sunthetic formation of spinels such as ferrous iron (magnetite) spinels, or chromite spinels is well known in the art. For example, there is presently available a chromizing procedure which is a surface treatment whereby chromium is diffused into a surface being treated as discussed briefly above. However, as stated there, this procedure requires relatively high temperatures, on the order of 1850° F., which makes it impractical for treating tubes in existing boilers. Moreover, while this chromium rich spinel adequately serves to reduce, if not prevent, spalling so long as it remains intact, like the oxide scale it is subject to spalling since it remains very close to if not at the outermost surface of the oxide layer.

In contrast to the procedure just described, the present invention provides for the formation of a spinel at the center of the duplex scale. Moreover, this spinel, which is also a chromium rich spinel in an actual embodiment, is not provided as a protective coating to reduce or eliminate spalling but rather to inhibit or retard the rate at which the duplex grows, as stated previously. As will be discussed hereinafter, this spinel is formed along with the duplex scale as a result of a pretreatment to surface 12 to be discussed below.

Before describing the pretreatment process of the present invention, attention is first directed to an actual sample of a 2.25% Cr-1% Mo ferritic steel tube which was subjected to steam at near atmospheric pressure for 2500 hours at 1150° F. This tube which was not pretreated remained isothermal, that is, it was not subjected to periodic cool-down periods. The inner surface of this tube is illustrated in FIG. 2 and, as shown there, has formed a duplex scale layer of steam-grown oxide, which is approximately 24 mils thick. This duplex scale which is generally indicated at 16 may be divided into two sections or sublayers, an outer sublayer **16*a* and an inner sublayer 16*b* which are of approximately equal thicknesses and which are divided by a center boundary 16*c* at the same location as the original surface. Each of the sublayers 16*a* and 16*b* consists primarily of iron oxide which by means of X-ray diffraction was shown to be magnetite ($Fe_3O_4$) as opposed to hematite ($Fe_2O_3$). Also, the SEM showed that the inner sublayer 16*b*** was significantly more dense than the outer sublayer, as indicated in FIG. 2. Moreover, the EDX analysis of FIG. 3 shows the various levels of chromium, molybdenum, silicon and manganese. Note that there is a relatively large amount of Cr, Mo and Si in the inner sublayer and a relatively small amount of Mn. On the other hand, there is virtually no Cr in the outer sublayer and only slight amounts of Mo and Si and these are concentrated near the boundary. However, there is a measurable increase in the amount of Mn across the outer sublayer, although the outermost 50 microns is virtually entirely magnetite. While the exact nature of this duplex scale is not particularly pertinent to the present invention, what is pertinent is the fact that upon visual inspection of the duplex scale, evidence of scale spalling was found. Similar scaling has been found in tubing subjected to high temperature air environments free of steam.

A second specimen was provided and was identical to the one just described, of course, before the latter was subjected to steam. However, this second specimen was pretreated in accordance with the present invention. More specifically, its inner surface was degreased, pickled and passivated in accordance with conventional procedures for ferritic steel, using a sodium nitrite-phosphate passivation. Thereafter, in accordance with the present invention, a 10 to 20% solution of potassium and/or sodium chromate and/or dichromate acidified with chromic acid to a pH of about 5.3 to 6.7 was applied to the surface. The tube and the solution were heated under pressure with argon gas so as to obtain about 1500 psi at 580° F.±10° F. The temperature and pressure were maintained (static) for 100 hours, and then the tube was cooled. After this treatment the surface was water rinsed and dried and appeared dark brown to black. A test coupon indicated a continuous film of 2–5 microns thick. This film consisted primarily of $Cr_2O_3$.

Figure 4:
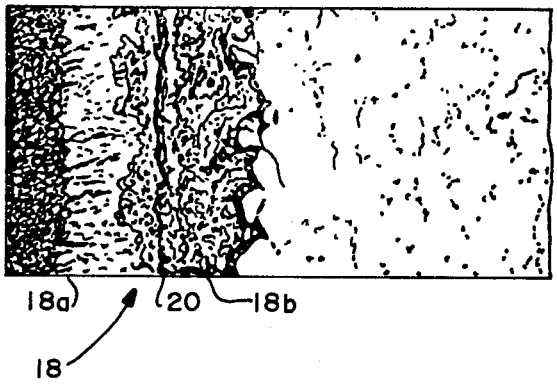
FIG. 4 is an SEM cross-sectional view similar to that of FIG. 2, but particularly illustrating the inner surface and duplex layer of a ferritic steel tube which has been pretreated in accordance with the present invention.

The tube just described, liked the control specimen of FIG. 2 was oxidized in steam at near atmospheric pressure for 2500 hours at 1150° F. However, unlike the control specimen, the pretreated specimen just described was subjected to a cool-down period every 504 hours. Each cool-down period consisted of reducing the temperature of the tube to 100° F. for 240 minutes before raising it back to 1150° F. The duplex scale which formed as a result of this procedure is illustrated in FIG. 4 and generally designated by the reference numeral 18. It should be apparent from this figure that the duplex scale formed in the pretreated specimen is significantly thinner than the duplex scale 16 of the control specimen. In fact, the duplex scale 18 is only 6.3 mils thick as compared to 24 mils for the control specimen. As also seen in FIG. 4, the duplex scale 18 includes an outer sublayer **18*a* and an inner sublayer 18*b* of equal thickness. Moreover, upon visual inspection, the duplex scale 18** was observed to be particularly dense and entirely free of evidence of spalling.

Figure 5:
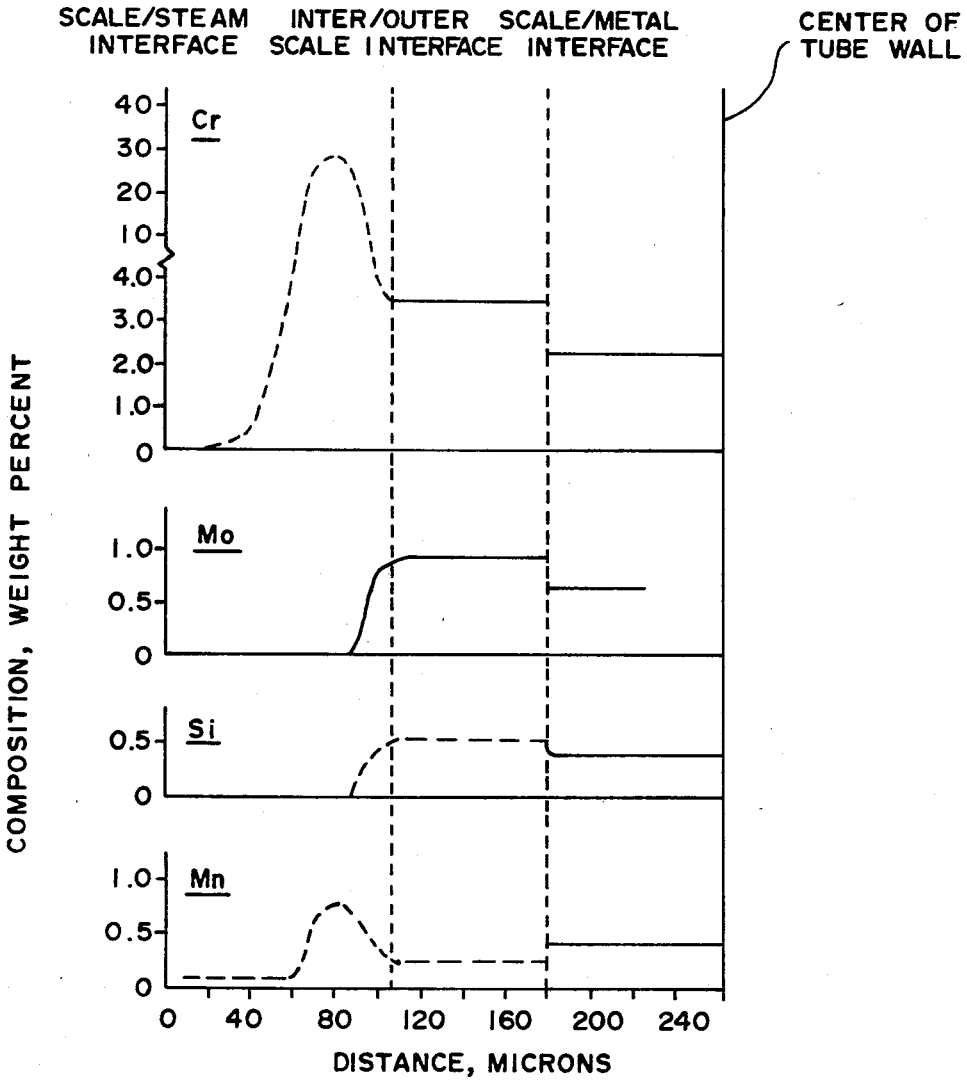
FIG. 5 is an Electron Microprobe line scan analysis, normal to the surface of certain components within the duplex layer of FIG. 4 and particularly illustrating the formation of a centrally located spinel.

With regard to the components making up the duplex scale 18, the latter is similar to the duplex scale 16 to the extent that its sublayers consist primarily of magnetite and to the extent that the inner sublayer **18*b* includes relatively large amounts of Cr, Mo and Si and a small amount of Mn while the outer sublayer includes a measurable increase in the amount of Mn, as seen in FIG. 5. However, as also seen in this figure and in FIG. 4, the duplex scale 18 includes a chromium-rich spinel layer 20 which is approximately centrally located within the duplex scale. This spinel layer which shows as an immense Cr peak in the microprobe analysis of FIG. 5 is a residual of the chromate pretreatment process described above. As seen in FIG. 5, this spinel layer is approximately 40 microns wide. Since the total thickness of the duplex scale is only about one-quarter of the duplex scale thickness of the control specimen, it must be concluded that the high chromium region found at the center of the duplex scale or actually just outside the initial steel surface is instrumental in dramatically reducing the growth rate of scale. Since the ratio of the thicknesses of the inner and outer sublayers is not changed by the pretreatment, that is, since the ratio of sublayers 18*a* and 18*b* is approximately the same as the ratio of the sublayers 16*a* and 16*b***, it must also be concluded that outward diffusion of $Fe^+$ ions from the inner sublayer to the outer sublayer inward diffusion of $O^=$ ions from the outer sublayer to the inner sublayer must have been impeded to about the same extent by the presence of the Cr spinel.

Having described a particular pretreatment process and the results attained thereby, it is to be understood that the present invention is not limited to that particular process. For example, a pretreatment process similar to the one described was provided on test specimens. However, in this process, the tube and solution (which was identical to the 12% solution described) were subjected to an environment including argon gas at a pressure of 1500 psi for only 48 hours rather than 100 hours and at a temperature of 550° F.±10% rather than 580° F.±10° F. with very similar results. Moreover, these two particular processes may not be the only way to form the centrally located spinel barrier described which results in reducing the rate at which the associated duplex scale forms to reduce the possibility of spalling. While the pretreatment procedures described are preferred, the present invention relates to any suitable procedures which are responsible for the formation of a central spinel resulting in the advantages attained thereby (as discussed) even though the spinel may not be the particular one described, that is, the chromite spinel. In fact, the present invention contemplates the formation of any suitable barrier which impedes diffusion of $Fe^{++}$ ions outward and $O^=$ ions inward in the manner described so as to slow down the overall formation process of the duplex scale. Further, the present invention is not limited to the particular ferritic steel tube described, that is, one which is comprised of 2.25% Cr-1% Mo ferritic steel, but rather any ferritic steel tube or other such article which in response to a pretreatment is capable of forming a central spinel or similar barrier for retarding the rate at which its duplex scale forms when subjected to high temperature steam over prolonged periods.

It is to be understood that the comparative analysis of the untreated tube illustrated in FIG. 3 with the pretreated tube of FIG. 5 was only one of a large number of comparative examples. For example, a second isothermal control specimen identical to the one represented by FIG. 2 (and FIG. 3) was provided along with a second pretreated specimen identical to the one represented by FIG. 4 (and FIG. 5). In this latter comparison, the scale thickness of the isothermal control specimen ranged between 15 and 17 mils where the thickness of the pretreated specimens ranged between 4 and 6 mils. In both cases, there was no actual exfoliation observed. However, cracks were observed on the inner surface of the control specimen upon cooling as well as poor scale adherence after testing whereas the scale of the pretreated specimen was stable and adherent.

A further comparative analysis was made and was identical to the one just described with one exception. Specifically, these latter specimens were subjected to steam at a temperature of 1200° F. as compared to 1150° F. The thickness of the duplex scale formed on the pretreated specimen was between 8 and 9 mils as compared to 23 to 24 mils for the duplex scale on the control specimen. In addition, while no exfoliation was observed on the pretreated specimen, the control specimen did show evidence of small spots and while the pretreated duplex scale appeared dense and adherent, the duplex scale formed on the control specimen cracked severely on cooling.

It is to be understood that the particular examples just recited as well as those examples previously recited have been provided in order to more fully appreciate the present invention and not for purposes of limiting the present invention. For example, in the pretreatment process of the present invention, the 10 to 20% solution described in a preferred embodiment can be made up of one or more of the constituents in the group consisting of potassium chromate, sodium chromate, potassium dichromate and sodium dichromate.

As stated above this solution is acidified with chromic acid to a pH of about 5.3 to 6.7. This solution is applied to the surface being treated and, thereafter, the surface is subjected to predetermined pressure, preferrably 500 psi to 1500 psi in a specific gaseous atmosphere, preferrably argon, for between about 48 and 100 hours at a temperature between about 540° F. and 650° F., preferrably for 70 to 100 hours at a temperature of about 570° F. to 590° F.

What is claimed is:

1. In a process in which a surface of a ferritic steel member is subjected to relatively high temperature air or steam for a period of time resulting in the formation of a duplex scale layer of steam-grown oxide at said surface, a method of reducing the possibility of scale spalling at said surface in response to thermal stress, said method comprising: pretreating said surface with particular substances including a non-corrosive chromate compound in a particular way to cause the formation of a chromite spinel barrier at the center of said duplex layer during formation of the latter, said barrier retarding the rate at which said duplex scale layer forms at said surface during said period, thereby reducing said possibility of scale spalling, said step of pretreating said surface including the steps of applying to said surface a solution selected from one or more non-corrosive compounds in the group consisting of potassium and sodium chromate and dichromate; confining said surface and applied solution to an environment including a predetermined gas; subjecting said solution applied surface in said environment to a predetermined pressure at a predetermined temperature for a predetermined period of time; and thereafter cooling said surface.

2. A method according to claim 1 wherein said solution is a 10% to 20% solution of said constituents which has been acidified to a pH of between about 5.3 and 6.7, wherein said gas is argon gas, and wherein said pressure is from 500 to 1500 psi.

3. A method according to claim 1 wherein said temperature is between about 570° F. and 590° F. and said time is about 70 to 100 hours.

4. A method according to claim 1 wherein said temperature is between about 540° F. and 560° F. and said time is about 50 hours.

5. In a process in which a surface of a ferritic steel member is subjected to relatively high temperature air or steam for a period of time resulting in the formation of a duplex scale layer of steam-grown oxide at said surface, a method of retarding the rate at which said duplex layer forms on said surface during said period, said method comprising: pretreating said surface with a particular non-corrosive chromate solution selected from one or more non-corrosive compounds in the group consisting of potassium and sodium chromate and dichromate, said surface being pretreated with said solution in a particular temperature and pressure controlled, gaseous environment to cause the formation of a chromite spinel at the center of said duplex layer during formation of the layer so as to divide the latter into inner and outer sublayers, said spinel impeding the outward diffusion of $Fe^{++}$ ions from said inner sublayer to said outer sublayer and the inward diffusion of $O^{=}$ ions from said outer sublayer to said inner sublayer whereby to retard the rate of formation of said duplex layer.

6. A method of treating a steel member to retard the rate at which scale forms on one surface thereof as a result of prolonged exposure of said surface to air or steam at relatively high temperatures, said method comprising: applying to said surface a 10 to 20% solution selected from one or more constituent in the group consisting of sodium and potassium chromate and dichromate which solution has been acidified with chromic acid to a pH of between about 5.3 and 6.7; confining said surface and applied solution to an environment including argon gas; subjecting said solution applied surface in said environment to a pressure of about 1500 psi at a temperature of between about 570° F. and 590° F. for about 70 to 100 hours; and thereafter cooling said surface.

7. A method according to claim 6 wherein said steel member is a low alloy steel member including 2.25% chromium and 1% molybdenum.

8. A method according to claim 7 wherein said member is a tube and said surface is the inner surface thereof.

9. A method of treating a steel member to retard the rate at which scale forms on one surface thereof as a result of prolonged exposure of said surface to air or steam at relatively high temperatures, said method comprising: applying to said surface a 10% to 20% solution selected from one or more constituent in the group consisting of sodium and potassium chromate and dichromate which solution has been acidified with chromic acid to a pH of between about 5.3 and 6.7; confining said surface and applied solution to an environment including argon gas; subjecting said solution applied surface in said environment to a pressure of about 1500 psi at a temperature of between about 540° F. and 560° F. for about 50 hours; and thereafter cooling said surface.

10. A method according to claim 9 wherein said steel member is a low alloy steel member including 2.25% chromium 15 and 1% molybdenum.

11. A method according to claim 10 wherein said member is a tube and said surface is the inner surface thereof.

12. A method according to claim 1 wherein said temperature is between about 540° F. and 650° F. and said time is between about 48 and 100 hours.

13. A method of treating a steel member to retard the rate at which scale forms on one surface thereof as a result of prolonged exposure of said surface to air or steam at relatively high temperatures, said method comprising: applying to said surface a 10% to 20% solution selected from one or more constituent in the group consisting of sodium and potassium chromate and dichromate which solution has been acidified with chromic acid to a pH of between about 5.3 and 6.7; confining said surface and applied solution to an environment including argon gas; subjecting said solution applied surface in said environment to a pressure of about 1500 psi at a temperature of between about 540° F. and 650° F. for between about 48 and 100 hours; and thereafter cooling said surface.

* * * * *